US005697441A

United States Patent [19]

Vercaemer et al.

[11] Patent Number: 5,697,441

[45] Date of Patent: Dec. 16, 1997

[54] SELECTIVE ZONAL ISOLATION OF OIL WELLS

[75] Inventors: Claude Joseph Vercaemer, Houston, Tex.; Stephen Nigel Davies, Cambridge, England; Demosthenis Georgeou Pafitis, Cambridge, England; Geoffrey C. Maitland, Cambridge, England; Jean Pierre Poyet, Dubai, United Arab Emirates

[73] Assignee: Dowell, a division of Schlumberger Technology Corporation, Houston, Tex.

[21] Appl. No.: 557,148

[22] PCT Filed: Jun. 23, 1994

[86] PCT No.: PCT/GB94/01358

§ 371 Date: Mar. 20, 1996

§ 102(e) Date: Mar. 20, 1996

[87] PCT Pub. No.: WO95/00739

PCT Pub. Date: Jan. 5, 1995

[30] Foreign Application Priority Data

Jun. 25, 1993 [GB] United Kingdom ..... 9313081

[51] Int. Cl.[6] ..... E21B 33/13

[52] U.S. Cl. ..... 166/285; 166/295

[58] Field of Search ..... 166/270, 276, 166/278, 295, 51, 300, 308, 285

[56] References Cited

U.S. PATENT DOCUMENTS

| | | | |
|---|---|---|---|
| 4,069,869 | 1/1978 | Sandiford | 166/270 |
| 4,539,292 | 9/1985 | Reid et al. . | |
| 4,559,310 | 12/1985 | Cantor et al. . | |
| 4,921,047 | 5/1990 | Summers et al. | 166/276 |
| 4,972,906 | 11/1990 | McDaniel | 166/276 |

FOREIGN PATENT DOCUMENTS

| | | |
|---|---|---|
| 2 240 798 | 8/1991 | United Kingdom . |
| 93 11337 | 6/1993 | WIPO . |

OTHER PUBLICATIONS

Perez et al., "cDNA cloning and immunological characterization of the rye grass allergen *Lol p 1*" *J. Biol. Chem.* (1990) 265:16210–16215.

(List continued on next page.)

*Primary Examiner*—Frank Tsay
*Attorney, Agent, or Firm*—John E. Vick, Jr.

[57] ABSTRACT

In the horizontal parts of deviated wells arranged within a producing formation, good communication between the formation and the wellbore liner is required, and this may be achieved by using a slotted or perforated liner in the horizontal section without any cementing to bond the liner to the wellbore. However, problems can arise if it is desired to work selectively in a zone in the horizontal section, since with a perforate liner there is no way of isolating the zone from the remainder of the well by using internal packers. This problem can be overcome by providing packers around the outside of the liner, this then allows packers inside the liner to be used to isolate a portion of the well. However, these external casing packers must be sealed against the wellbore, they must be positioned in advance, and they substantially increase the cost of the completion. The present invention suggests novel means of zonal isolation in a well with a perforate liner, this isolation being achieved by using a liquid composition that can be pumped into the relevant annular region between the liner and the wellbore and then set to form a plug that prevents communication from one side to the other except via the liner. More specifically, the invention provides a method of placing a plug around a perforate liner in which: a pair of spaced packers (14, 16) are placed inside the liner (12) to define both a chamber (20) inside the liner which includes a perforation (22) and also a region (24) to be plugged outside the liner, a predetermined volume of plugging fluid is pumped into the chamber and, via the perforation, into the region to be plugged; and after the plugging fluid has set the packers are removed from the liner.

10 Claims, 1 Drawing Sheet

U.S. PATENT DOCUMENTS

| | | | |
|---|---|---|---|
| 5,090,481 | 2/1992 | Pleasants et al. | 166/373 |
| 5,107,927 | 4/1992 | Whiteley et al. | 166/50 |
| 5,197,543 | 3/1993 | Coulter . | |
| 5,215,147 | 6/1993 | Grego et al. . | |
| 5,240,074 | 8/1993 | Peavy et al. | 166/286 |

OTHER PUBLICATIONS

Griffith et al., "Cloning and sequencing of *Lol p* 1, the major protein of rye–grass pollen" *FEBS Letters* (1991) 279:210–215.

Chua et al., "Sequencing analysis of cDNA coding for a major dust mite allergen" *J. Exp. Med.* (1988) 167:175–182.

Robinson et al., "Allergens as proteases: an *Aspergillus fumigatus* protease directly induces human epithelial dell detahment" *J. Allergy Clin. Immunol.* (1990) 86:726–731.

Homburger et al., "Methods in laboratory immunology. Principles and interpretation of laboratory tests for allergy" (1992) *Allergy Principles and Practice* (Middleton et al., eds.,) pp. 554–572.

Løwenstein et al., "Antigens of *Ambrosia elatior* (shot ragweed) pollen. III. Crossed radioimmunoelectrophoresis of ragweed–allergic patients' sera with special attention to quantification of IgE responses" *J. Immunol.* (1983) 130:727–731.

Blanchard et al., "Characterization of some of the enzymes in ragweed pollen" *Ann. Allergy* (1976) 36:410–418.

Bousquet et al., [Pollen Enzymes]. *Rev. Fr. Allergol. Immunol. Clin. (France)* (1978) 18:131–138. Abstract only. EMBASE No. 79064779.

Chao et al., "Isolation and characterization of a neutral aminopeptidase from June grass (*Poa pratensis*) pollen" *Allergy Clin. Immunol.* (1990) 85:280. Abstract #546.

SELECTIVE ZONAL ISOLATION OF OIL WELLS

The present invention relates to a method of selectively isolating zones of oil wells or the like in which a liner or casing is situated in the well but is not continuously cemented to the wellbore wall so as to be isolated therefrom.

In conventional well completion a tubular liner or casing is run into the well after it is drilled, and cement is pumped between the casing and the wellbore wall and allowed to set. This isolates the various zones of the well from each other, and so prevents, for example, oil from entering aquifers which might be at lower pressure and providing drinking water. Where it is desired to allow formation fluids such as oil or gas to enter the well, the lining and cement are perforated by an explosive charge in order to provide a channel for the fluid to enter the lining so that it can pass more sensitive zones without causing damage or pollution.

This technique generally works well in wells which are more or less vertical, since it is straightforward to run the liner into the well, to ensure it is centralised, and to ensure that cement is placed evenly around the liner and bonds to both the liner and the wellbore. However, when the well is deviated from vertical—particularly when highly deviated, even horizontal—certain problems can occur. In particular, it is often difficult to ensure that the liner remains central in the well before the cement is placed. There is a tendency for the liner to lie on the lower side of the well such that when the cement is pumped it flows easily along the high side of the liner, but little if any penetrates around the low side; this can lead to bonding problems. Also, the tools used to perforate the liner and cement can become eccentred, and then do not operate efficiently.

The horizontal parts of deviated wells are often arranged so as to remain within a producing formation, and therefore in these sections good communication between the formation and the liner is required whereas in the vertical sections leading to the surface good zonal isolation is required. One technique which is used in such horizontal situations is to provide a perforate liner—for instance, a slotted, perforated, or predrilled liner, or a screen or a pre-packed screen—in the horizontal section of the well without any cementing to bond the liner to the wellbore, the annular gap between the liner and the wellbore either being left "empty" or (as may be preferable in certain circumstances) being packed with suitably-sized gravel. However, problems can arise if it is desired to perform a selective well treatment on, or produce selectively from, one zone in the horizontal section since inside a perforate liner there is no way of isolating the zone in question from the remainder of the well by using packers as is done with a conventional liner, because fluid can by-pass the plug by exiting the liner into the annular space therearound. One technique which has been proposed to overcome this problem is to provide one or more packers around the outside of the liner (external casing packers) which contact the wellbore and provide localised restriction to communication outside the liner; this then allows packers inside the liner to be used to isolate a portion of the well. Unfortunately, there are also problems associated with the use of external casing packers; they must be sealed against the wellbore, they must be positioned in advance, and they substantially increase the cost of the completion.

U.S. Pat. No. 5,197,543 discloses a method of isolating regions of a horizontal wellbore in an unconsolidated formation involving placement of alternating blank (unperforated) liner sections such as 32*a*, 32*b* and screen sections, eg slotted liners, such as 30*a* 30*b*, 30*c*. Internal plugs 42, 44 are positioned in blank liner sections adjacent the region to be plugged, and plugging liquid is pumped through the intervening screen section into the surrounding formation. The technique is only described in connection with treatment of unconsolidated formation, where the surrounding formation has collapsed around at least the blank liner sections.

The present invention seeks to provide means of zonal isolation in a well with a perforate liner which can be positioned according to requirements; the invention proposes that this be achieved by using a liquid composition that can be pumped, into the relevant annular region between the liner and the wellbore and there set to form a plug that prevents communication from one side to the other except via the liner.

In one aspect, therefore, the present invention provides a method of placing a plug in a region around a perforate liner in a wellbore, the method comprising:

placing a pair of packers inside the liner where the plug is to be positioned, the packers being spaced apart so as to define a chamber inside the liner which includes a perforation and also a region to be plugged outside the liner; and pumping a predetermined volume of plugging fluid into the chamber and, via the perforation, into the region to be plugged, which predetermined volume of plugging fluid is sufficient to displace substantially all other-fluids from the region to be plugged.

Although it may be desirable in some cases—for example, when abandoning the section of the well beyond the emplaced plug—to leave the pair of pipe-internal packers in position, most usually it will be appropriate to remove then to clean away the residue of plugging fluid remaining within the liner itself.

The volume of the chamber is preferably smaller than the volume of the region to be plugged in order to reduce the amount of plugging fluid which must be cleaned from the liner after placement of the plug.

The perforate liner can take any suitable form. Typically, it is a slotted liner or a pre-packed screen.

The plugging fluid is typically a cement or the like which has appropriate rheological properties to displace other fluids when pumped into the region and to remain there while it sets so as to seal against the wellbore and the casing and form an impermeable plug. Prior to its use, it may be desirable to pump a wash fluid through the chamber and region to be plugged. These wash fluids and their pumping rates are well-known in the field of cementing and well treatment, and are designed according to the particular nature of the job in hand.

The plugging fluid is conveniently pumped either from the surface to the chamber via a tube, or by means of a downhole pump from a reservoir located near the packers in the wellbore.

Most preferably the volume of fluid is such that when in the annulus it does not extend beyond the limit of the packers, but nevertheless it is possible for the fluid to extend past them (although, to prevent the fluid then re-entering the liner, it is desirable that the critical pressure drop along the annular region being plugged does not exceed the pressure drop across the slots in the liner—i.e. no fluid enters the liner beyond the packer).

Once the plugging fluid is in place in the annulus it will normally be the case that the residue of the fluid in the chamber (and possibly in the liner outside the packer pair) needs to be washed out. Again, suitable wash fluids and their pumping rates are well-known in the field of cementing and well treatment, and need no further comment here.

The plugging fluid is designed to meet various requirements—thus: to allow mixing and processing at the surface, and pumping through the tubing to the chamber; to ensure adequate placement into the region to be plugged; to remain in position during set, and prevent re-entry of the fluid into the liner when the packers are moved; and to set to provide an impermeable area in the region. The optimum fluid is thixotropic, where the characteristic gelling time of the fluid is shorter than or comparable to the time taken to displace the fluid into the region, and the gel strength or viscosity of the material is sufficient to eliminate gravity-induced flows. The required gel strength and gelling time are calculated to achieve optimum displacement for the specific geometry of the region, the pumping time and the density difference between the fluid and the oil/water initially filling the region for each job. The plugging fluid should possess the following properties to be useful in this method:

1) It should be a setting system—i.e., fluid when pumped but capable of changing to a solid after it has been placed.
2) It should not slump under gravity—i.e., its gel strength is reasonably high. However, when the fluid is being pumped into the region a degree of gravity-induced flow to the lower side is desirable since this is the region where placement is most difficult.
3) It must be sufficiently pumpable to be delivered through the tubing to the relevant site.

In order that the fluid can possess all of these requirements it is highly desirable that it be thixotropic in nature, since during pumping the confining pressure keeps the fluid tight against the borehole walls and liner surface but once pumping stops there are no containment pressures so the plug must become substantially "self-supporting" very quickly, so as not to move significantly along the annulus.

Examples of suitable fluids are: foamed cements; unfoamed cements containing smectic clays such as bentonite and attapulgite; unfoamed cements containing welan gum, aluminium and/or iron sulphate, and/or calcium sulphate (gypsum) as thixotropy agents; thermosetting polymers such as epoxy, vinylester, phenolic and polyester resins; and cross-linking polymer gels (possibly with an added thixotrope).

An example of a particular suitable fluid, designed for a test in a one third scale model of a typically 7" (about 17.5 cm) slotted liner, is:

| | |
|---|---|
| Class A cement | 720 pbw |
| Gypsum | 72 pbw |
| Water | 349 pbw |

Another example of a suitable fluid is:

| | |
|---|---|
| Class G cement | 792 pbw |
| Thixotrope* | 0.05 pbw |
| Water | 349 pbw |

* The thixotrope was a mixture of 32.8% alnminium sulphate, 4.5% ferrous sulphate, 3% sulphuric acid and 59.7% water, by weight.

It will be appreciated, of course, that it may be necessary to choose a plugging fluid of a type that is suited to the variety of liner being employed, for certain plugging fluids should not be used with certain types of liner—thus, if the liner is a pre-packed gravel screen then it would be quite unsuitable to employ as the plugging fluid a conventional cement composition, and instead one of the several resin fluids should be used. Which plugging fluid is suitable for which liner variety will be evident to those skilled in the art, but by way of guidance it can be said that cement fluids should only be used where the liner perforations are greater than about six times the maximum cement grain size.

After the plug is in place, and set, the only fluid flow which is possible at the plug is through the liner (which can of course be sealed with a packer if required).

After the plugging fluid has been pumped into the region to be plugged, the packers are desirably moved to a location separate from the region to be plugged, and some suitable fluid, preferably a wash fluid specifically designed to remove the plugging fluid, is circulated through the chamber and liner to remove unwanted plugging fluid therefrom.

The technique described above provides a single plug around the liner. To effect treatment to a particular zone of a well having a perforate liner it is typically necessary to set two or more such plugs, such that there is one plug on either side of the zone in question. Packers can then be rim into the liner and sealed against the plugs so as to isolate the zone therebetween and allow a selective treatment to be applied to that zone. It will be appreciated that if the treatment zone is near the bottom of the well or another plug may only be necessary to set a single plug to define the zone.

The techniques described above mostly require that the plugging fluid be pumped from the surface to the region in question. In an alternative embodiment, the fluid can be held in a downhole reservoir near the region, and pumped through the chamber using a downhole pump. This lessens the strict rheological requirement of the fluid, and allows downhole mixing of two-part fluids or the like—for example, epoxy resins—which can set rapidly in the region without causing problems in the tubing itself. A downhole source of radiation such as UV or heat might be provided near the region to trigger or aid the setting of the plugging fluid. Triggering of downhole pumps or sources can be achieved by in situ measurements—for example, the conductivity of fluids passing through the tool. An alternative is to use encapsulated cross-linking agents which can be released by thermal, chemical or mechanical degradation.

In a second aspect the invention provides a method of isolating a zone of a well which is lined with a perforate liner, this method comprising: placing plugs on either side of the zone according to the method of the invention; and then setting a packer in the liner adjacent each plug.

There are occasions other than when dealing with the special problems posed by perforate liners when it may be desirable to form a plug in the well (perhaps in the well itself, or possibly in the annular region between the wellbore wall and some tubing within the wellbore), and the technique disclosed herein of employing as the plugging material a thixotropic fluid, which is itself a novel concept not hitherto proposed in the Art, may be useful for this purpose. Such occasions include selective abandonment of a section of the well, as well as the regulated fill of a washout. Accordingly, in a further aspect the invention provides a method of forming a plug in a region in a well, in which method a volume of plugging fluid is pumped into the region, conveniently via suitable packer apparatus such as a pair of region-delimiting packers, which volume is sufficient to displace substantially all other fluids from the region to be plugged, the plugging fluid being significantly thixotropic.

The plugging fluid is significantly thixotropic—that is to say, its shear yield strength $Tau_y$ (the force required notionally initially to move a unit contact area block) must be such that under the likely ambient conditions the fluid flows readily when being pumped and yet rapidly gels when pumping stops. Naturally, acceptable values of $Tau_y$ depend upon the physical parameters of the well (of the wellbore and of any tubing therein). In order to flow easily along a 5½ inch (about 12 cm) liner, for example, when the shear rates are high, $Tau_y$ should preferably be around 50Pa or less (such a fluid will also flow easily through the likely holes in a perforate liner), while to gel sufficiently rapidly and completely within an annulus of between 1 and 4 inches (about 2.5 to 10 cm) width, and outside diameter 8 inches (about 20 cm), when the shear rates are low, $Tau_y$ should preferably be around 150Pa or greater. Of course, the evolution of $Tau_y$ from its lower to its higher value should most desirably occur within a short time span suited to the circumstances—and 15 seconds, say, is generally satisfactory.

The invention will now be described with reference to the accompanying drawings, in which: shows a schematic side view of a plugged operation in FIG. 1 shows a schematic side view of a plugged operation in accordance with the present invention;

Figure 1:
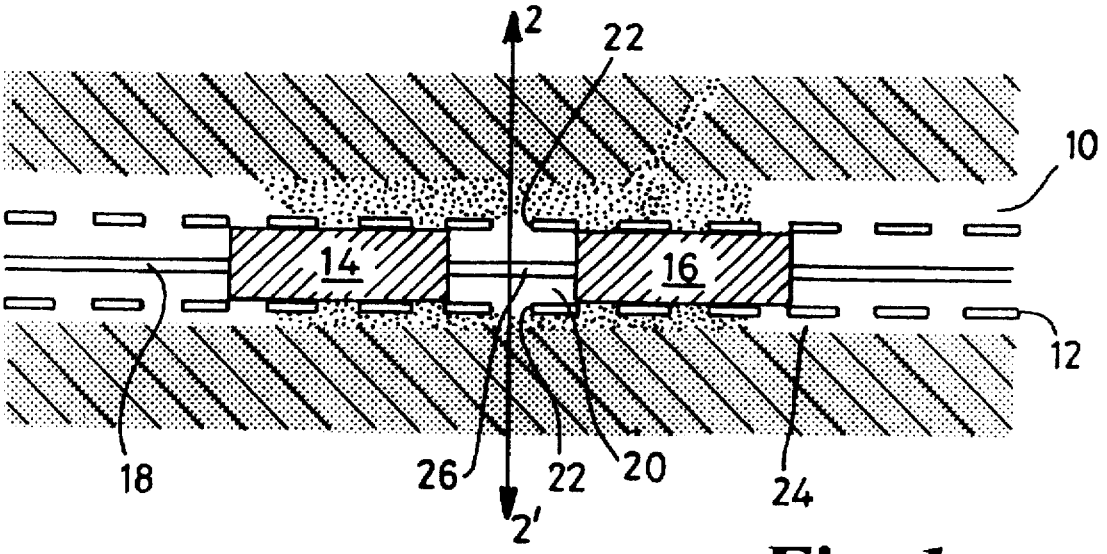
Figure 2:
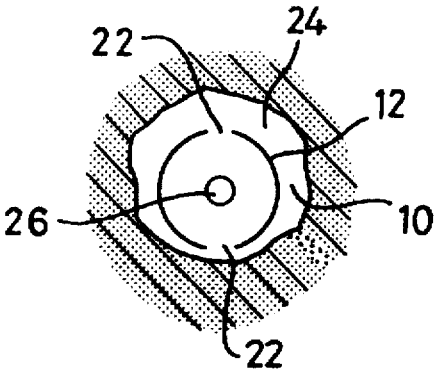
FIG. 2 shows a cross-section on the line AA' of FIG. 1.

Referring to FIGS. 1 and 2, there is shown a horizontal wellbore 10 in which a slotted liner 12 has been located. The liner 12 is not cemented to the formation, and fluid can move along the well either inside or outside the liner 12.

The method of the present invention is performed by running a pair of packers 14,16 into the liner 12 from the surface by means of tubing 18. The packers 14,16 are spaced apart in the tubing 18 such that when they are inflated inside the slotted liner 12 a chamber 20 is defined, there being slots 22 in the liner 12 allowing communication between the chamber 20 and the exterior region 24 of the liner 12. A port (not shown) is provided in the portion 26 of the tubing 18 passing between the packers 14,16 in the chamber 20.

In use, the region to be plugged is identified in the conventional manner, and the tubing 18 and packers 14,16 are run into the liner 12 until they are level with the region 24. The packers 14,16 are then inflated so as to seal against the inner surface of the liner 12. A wash fluid can be pumped through the tubing 18 into the chamber 20 through the port and then into the region 24 through the slots 22. The chemical nature of this fluid and the rate of pumping is designed to clean the outer surface of the liner 12 and the wellbore wall and leave them water wet.

After the wash fluid, a predetermined volume of plugging fluid, usually cement, is pumped through the tubing 18 into the chamber 20 and the region 24 outside the liner 12. The theological properties of the fluid and the rate of pumping are chosen to ensure the optimum removal of fluids or other material in the region 24 to be plugged. The size of the chamber is made as small as possible, so that the amount of fluid present when the plugging fluid is pumped is kept as small as possible thus reducing contamination of the plugging fluid (also, the smaller the chamber the smaller the amount of plugging fluid that will have to be cleaned from inside the liner when the plug has been placed). Once the appropriate volume of cement has been introduced into the region 24, pumping is stopped. The volume is such that the cement does not extend beyond the limits of the packers 14,16 but fills the region 24 to be plugged completely so as to bond to the borehole wall and the liner 12. The packers 14,16 are then partially deflated, and are moved away from the treatment area. Any remaining cement is then pumped out of the tubing 18 and chamber 20. Sufficient volumes of a flushing fluid are then circulated to ensure removal of unwanted cement. The packers 14,16 are then totally deflated, and further flushing fluid is circulated to ensure that the liner 12 is left clear. The cement forming the plug is left to harden.

Figure 3:
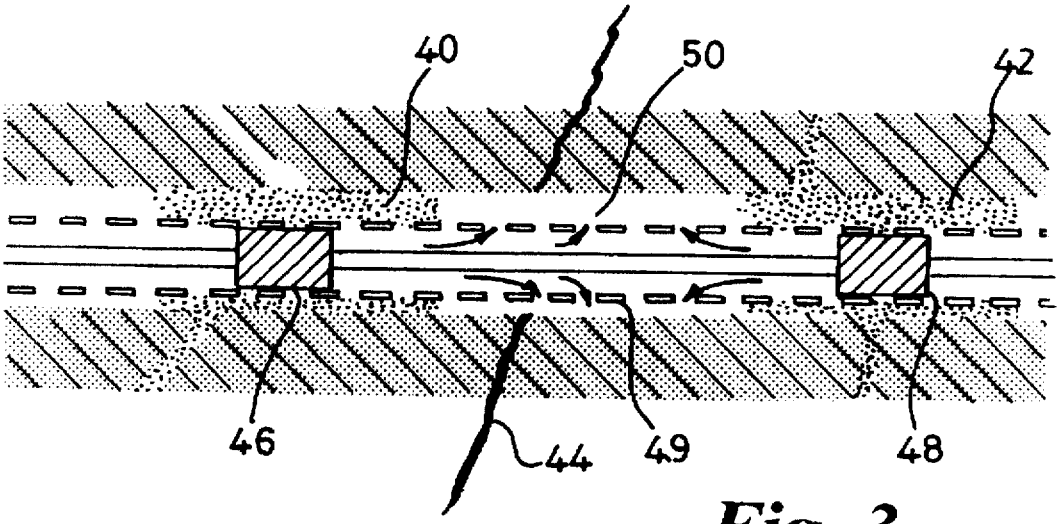
FIG. 3 shows a selective treatment performed in a well which has been plugged in accordance with the present invention.

In FIG. 3 plugs 40,42 are set on either side of a water entry 44 which is to be sealed. Packers 46,48 are run into the liner or tubing 49. The packers 46,48 are set at each plug 40,42, and treatment fluid is pumped into the treatment zone 50 to seal off the water entry.

The tubing used to set the packers 14,16 or 46,48 can include a bypass so that fluids can pass up the well past the region at which the plug is being set or the zone undergoing treatment. This means that the well does not have to be shut in while completing these operations, and so avoids formation damage leading to loss of production from the well.

We claim:

1. A method of placing a plug in an uncollapsed region around a continuous perforate liner in a wellbore; said method comprising the steps of:

placing a pair of inflatable packers along a predetermined length of said perforate liner so as to seal against an inner surface of said liner where the plug is to positioned, said packers being spaced apart so as to define both a chamber inside the perforate liner and the uncollapsed region to be plugged outside the liner;

pumping a predetermined volume of a thixotropic plugging fluid into the chamber and, via the perforate liner, into the region to be plugged, said plugging fluid being characterized by a gelling time comparable to or shorter than the time taken to displace the fluid into the region and by having a gelling strength after said gelling time sufficient to eliminate gravity-induced flow; and removing said packers.

2. A method as claimed in claim 1, wherein the volume of the chamber is smaller than the volume to be plugged.

3. A method as claimed in claim 1, wherein the perforate liner is a slotted liner or a pre-packed screen.

4. A method as claimed in claim 3, wherein the perforate liner is a slotted liner and the plugging fluid is a cement, or the perforate liner is a pre-packed screen and the plugging fluid is a resin.

5. A method as claimed in claim 1, in which, prior to pumping in the plugging fluid, a wash fluid is pumped through the chamber and region to be plugged.

6. A method as claimed in claim 1, in which, after the plugging fluid has been pumped into the region to be plugged, the packers are moved to a location separate from the region to be plugged, and a wash fluid is circulated through the chamber and perforate liner to remove unwanted plugging fluid therefrom.

7. A method as claimed in claim 1 including the steps of:

placing tubing through said inflatable packers; and placing a port in said tubing between said packers for the supply of plugging fluid from said tubing into said chamber.

8. A method of isolating a zone of a well which is lined with a continuous perforate liner along a predetermined length of the well, the method including the steps of:

placing plugs on either side of the zone along a predetermined length of the perforate liner, the step of placing plugs on either side of said zone including the steps of:

placing a pair of packers inside the perforate liner where one of the plugs is to be positioned, the packers being spaced apart so as to define both a chamber inside the perforate liner and also a region to be plugged outside the perforate liner;

pumping a predetermined volume of a plugging fluid into the chamber, and via the perforate liner, into the region to be plugged, the plugging fluid being sufficient to displace substantially all other fluids from the region to be plugged; and removing said packers.

9. A method as claimed in claim 8 wherein the plugging fluid has a gelling time comparable to or shorter than the time taken to displace the fluid into said region and a gelling strength after said gelling time sufficient to eliminate gravity-induced flow.

10. A method as claimed in claim 9 including the further steps of:

placing tubing through said packers and placing a port in said tubing adjacent said packers for the supply of plugging fluid from said tubing into said chamber.

* * * * *